US007500661B2

(12) United States Patent
Liu et al.

(10) Patent No.: US 7,500,661 B2
(45) Date of Patent: Mar. 10, 2009

(54) SELF-CLAMPING MECHANISM

(75) Inventors: Fengyu Liu, Mason, OH (US); Hongwei Liu, Mason, OH (US)

(73) Assignee: Shirley Tech, LLC, Mason, OH (US)

( * ) Notice: Subject to any disclaimer, the term of this patent is extended or adjusted under 35 U.S.C. 154(b) by 0 days.

(21) Appl. No.: 11/686,088

(22) Filed: Mar. 14, 2007

(65) Prior Publication Data

US 2007/0228631 A1 Oct. 4, 2007

Related U.S. Application Data

(60) Provisional application No. 60/744,251, filed on Apr. 4, 2006.

(51) Int. Cl.
*B25B 1/08* (2006.01)

(52) U.S. Cl. ..... 269/234; 269/95; 81/175; 81/165

(58) Field of Classification Search ..... 269/234, 269/43, 45, 95; 81/179, 170, 176.1, 165
See application file for complete search history.

(56) References Cited

U.S. PATENT DOCUMENTS 1,551,763 A * 9/1925 Morris ..... 81/185.1
1,557,864 A * 10/1925 Mull ..... 81/185.2
1,958,705 A 5/1934 Klein
2,020,809 A 11/1935 Stock
2,636,409 A 4/1953 Milus
2,840,207 A 6/1958 Keck
2,893,275 A * 7/1959 Lindemann ..... 269/310
2,959,996 A * 11/1960 Wheeler ..... 81/179
4,114,868 A 9/1978 Smith
4,223,879 A 9/1980 Wolfe et al.
4,706,528 A * 11/1987 Inoue ..... 81/179
4,804,171 A * 2/1989 Dornfeld ..... 269/138
4,834,356 A 5/1989 Fox
5,203,434 A 4/1993 Teeter et al.
6,126,159 A * 10/2000 Dornfeld ..... 269/138
6,234,465 B1 5/2001 Sutton, Jr.
6,739,223 B2 * 5/2004 Wu ..... 81/179
2007/0228631 A1 * 10/2007 Liu et al. ..... 269/234

* cited by examiner

*Primary Examiner*—Lee D Wilson
(74) *Attorney, Agent, or Firm*—Wood Herron & Evans, LLP

(57) ABSTRACT

A self-clamping mechanism includes a first support surface and a clamping member in sliding contact with the first support surface. The clamping member has a first surface in confronting engagement with the first support surface, and a second surface for engaging the surface of an object to be clamped by the mechanism. The first and second surfaces of the clamping member are disposed at a predetermined angle, θ, such that when certain conditions are met, the object will remain clamped by the mechanism regardless of external forces applied to the object.

11 Claims, 8 Drawing Sheets

SELF-CLAMPING MECHANISM

The present application claims the filing benefit of co-pending U.S. Provisional Patent Application No. 60/744,251, filed Apr. 4, 2006, which is incorporated by reference herein in its entirety. The present application is related to Chinese Patent Application No. 200610149034.2, filed Nov. 17, 2006 and Chinese Patent Application No. 200620159246.4, filed Nov. 17, 2006.

TECHNICAL FIELD

The present invention relates generally to devices for clamping and holding objects, and more particularly to a self-clamping mechanism.

BACKGROUND

Clamping mechanisms have been used in a variety of applications to hold objects in fixed positions or orientations. For example, vises or other clamping mechanisms have been used to hold workpieces in desired positions while machining operations are performed on the workpieces. Generally, prior clamping mechanisms have required the application of considerable external forces or power to maintain clamping forces on objects held in the mechanisms. Accordingly, these devices typically require a considerable amount of energy to maintain clamping forces, and can also damage clamped objects, especially if the objects are delicate or fragile. Other clamping mechanisms have utilized rough surfaces, such as serrated or toothed surfaces, in an attempt to increase the holding ability of the clamping mechanisms. However, toothed or serrated clamping surfaces do not greatly improve the holding capacity of prior clamping mechanisms, and objects will tend slip from the clamping surfaces if the frictional forces at the clamped interface are exceeded. When parts begin to slip, these prior art devices do not automatically react to maintain the clamp forces on the object. Moreover, these serrated or toothed surfaces can damage the clamped objects, and are particularly undesirable if the surface quality of the clamped object is an important feature.

A need therefore exists for a clamping mechanism that overcomes these and other drawbacks of prior clamping mechanisms.

SUMMARY

The present invention overcomes the foregoing and other shortcomings and drawbacks of mechanisms heretofore known for use in clamping an object. While the invention will be described in connection with certain embodiments, it will be understood that the invention is not limited to these embodiments. On the contrary, the invention includes all alternatives, modifications and equivalents as may be included within the spirit and scope of the present invention.

In one aspect of the invention, a self-clamping apparatus for clamping an object comprises a first support surface and a clamping member. The clamping member includes a first substantially smooth first surface in confronting engagement with the first support surface, and a substantially smooth second surface for engaging a surface of the object. The first surface of the clamping member is slidably movable along the first support surface and is disposed at an angle, θ, relative to the second surface. When the angle θ satisfies the conditions set forth hereinbelow, the object will be securely clamped by the apparatus regardless of external forces applied to the object.

In one embodiment of the invention, the clamping apparatus is in the form of an adjustable wrench. The wrench has a fixed jaw and a movable jaw. The clamping member may be provided on either the fixed or the movable jaw to facilitate securely clamping an object. The wrench may further include guide rods associated with the clamping member and constraining movement of the clamping member along the first support surface.

In another embodiment, the clamping apparatus includes a disk defining at least two planar surfaces that are inclined at an angle θ in directions radially outwardly from a center of the disk. The clamping member comprises at least first and second portions, each portion associated with one of the planar surfaces of the disk for sliding movement therealong. When an object is in contact with the respective second surfaces of the clamping member portions, the apparatus resists movement of the object in directions radially outwardly from the center of the clamping member.

In yet another embodiment, the clamping member is slidably rotatably movable relative to the first support surface. In this embodiment, the angle θ defines a helix angle at the interface of the first support surface and the first surface of the clamping member. The clamping apparatus resists rotational movement of an object contacting the second surface of the clamping member.

In yet another embodiment, the clamping member includes a second surface that is arcuate in shape to engage the outer circumference of a rod-shaped object. In this embodiment, the clamping apparatus resists axial pull-out of the rod-shaped object from the clamping apparatus.

These and other features, objects and advantages of the invention will become more readily apparent to those skilled in the art in view of the following detailed description, taken in conjunction with the accompanying drawings.

BRIEF DESCRIPTION OF THE DRAWINGS

The accompanying drawings, which are incorporated in and constitute a part of this specification, illustrate embodiments of the invention and, together with the general description of the invention given above, and the detailed description given below, serve to explain the principles of the invention.

DETAILED DESCRIPTION

Figure 1:
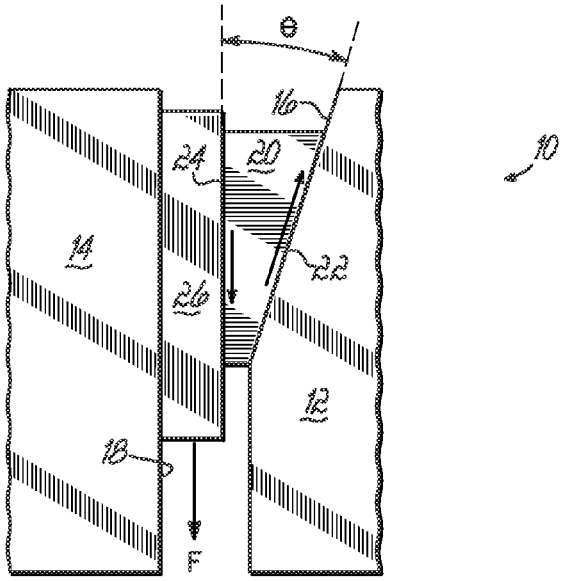
FIG. 1 is a schematic illustration of a clamping mechanism in accordance with the principles of the present invention.

The present invention takes advantage of the relative frictional forces between an object to be clamped and the clamping surfaces of a clamping mechanism in accordance with the principles of the present invention. In particular, the clamping mechanism utilizes a sliding wedge to optimize the frictional forces of the device to react against movement of the clamped object without requiring the application of high external clamping forces. FIG. 1 depicts an exemplary clamping mechanism 10 in accordance with one embodiment of the present invention. The mechanism 10 includes first and second oppositely disposed supports 12, 14, defining respective first and second support surfaces 16, 18, and a clamping member 20 disposed therebetween. A first surface 22 of the clamping member 20 confronts the first support surface 16 and is slidably movable therealong. A second surface 24 of the clamping member 20 is adapted to engage the object 26 to be clamped, and is disposed at an angle θ relative to the first surface 22, wherein the angle θ is defined by:

$$\frac{k + \tan(\theta)}{1 - k\tan(\theta)} \leq \mu$$

wherein:

μ=the coefficient of friction between the clamping member and an object to be clamped k=the coefficient of friction between the clamping member and the support surface.

When the angle θ satisfies the equation above, the object 26 will be securely clamped by the mechanism 10 regardless of forces F which may be applied to the object, as depicted in FIG. 1. The clamping mechanism 10 operates to apply a force to the clamped object 26 in a direction normal to the clamp interface between object 26 and second surface 24 in response to applied force F. The normal force will increase proportionally with the applied force F, and the magnitude of the normal force will only be that which is necessary to maintain the object 26 in the clamped condition. Accordingly, no additional external forces need be applied to the mechanism 10 to maintain the object 26 in the clamped condition.

In one embodiment, the friction coefficients of the clamping member 20 and the first support surface 16 are selected such that the friction coefficient μ between the clamped object 26 and the clamping member 20 is greater than the friction coefficient k between the clamping member 20 and the first support surface 16. In accordance with one embodiment, the first support surface 16 and the first and second surfaces 22, 24 of the clamping member 20 may be substantially smooth, dry surfaces to achieve the desired friction coefficients. As used herein, a substantially smooth surface is intended to mean one generally without serrations, teeth, or other formations on the surface that are intended to bite into the surface of the clamped object and which would tend to affect the surface finish of the object when clamped by the clamping mechanism.

The surfaces 16, 22, 24 may also be coated, or otherwise treated, to obtain desired friction coefficients so that the conditions of the equation set forth above are met. For example, the second surface 24 of the clamping member 20 may be coated or treated to increase the friction coefficient at the interface between the clamping member 20 and the object 26, while the first surface 22 of the clamping member 20 and/or the first support surface 16 may be coated or treated to decrease the friction coefficient between the clamping member 20 and the first support surface 16. Alternatively, a material, such as a sheet having desired frictional properties, may be disposed between the first surface 22 of the clamping member 20 and the first support surface 16 to decrease the friction coefficient at the interface therebetween. In embodiments where no teeth, serrations, or other modification of the second surface 24 are utilized, the clamping mechanism 10 will not damage the surface of the clamped object 26.

In one embodiment, the angle θ between the first and second surfaces of the clamping member is in the range of about 3 degrees to about 6 degrees. In another embodiment, the angle θ is about 3 degrees.

While FIG. 1 depicts a second support 14 providing a second support surface 18 for clamping an object 26 between the second support surface 18 and the clamping member 20, certain applications may not require the use of a second support 14, as will be described more fully with respect to various embodiments below.

Figure 2:
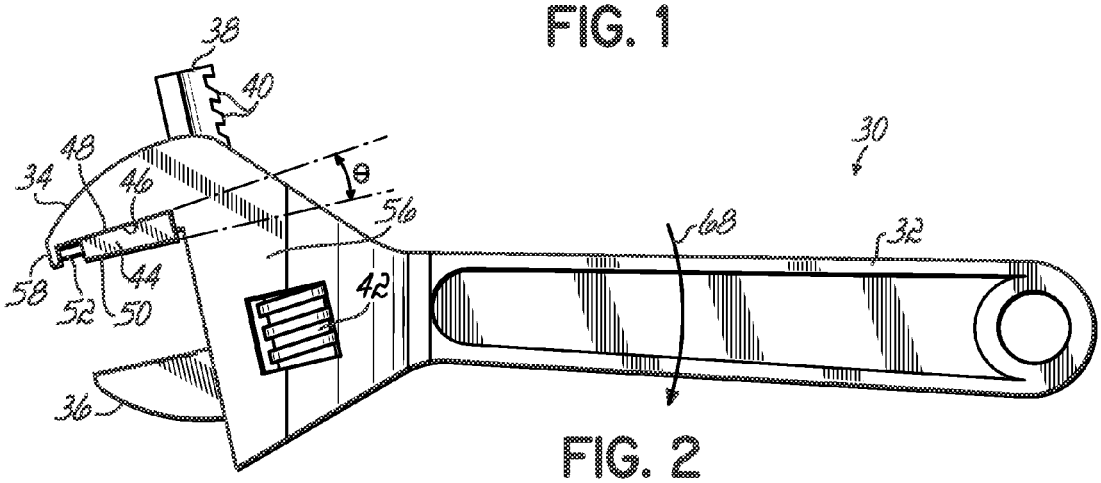
FIG. 2 is an exemplary clamping mechanism in accordance with the principles of the present invention, in the form of an adjustable wrench.
Figure 3:
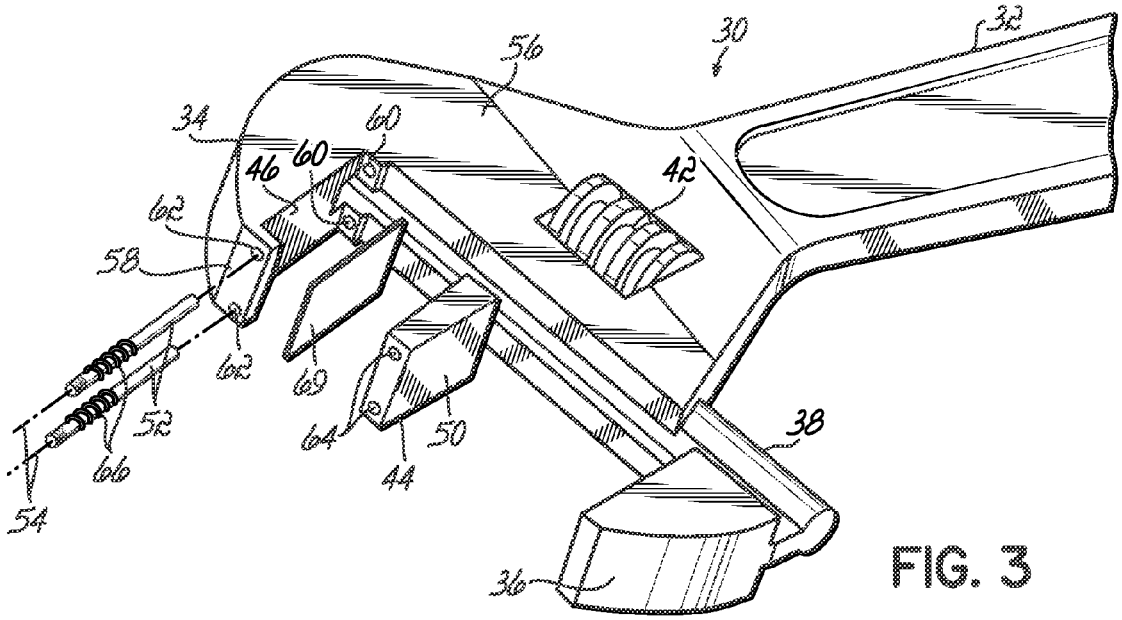
FIG. 3 is an exploded detail view of the adjustable wrench of FIG. 2.

FIGS. 2 and 3 illustrate an exemplary clamping mechanism in accordance with the principles of the present invention, in the form of an adjustable wrench 30. In many respects, the wrench 30 resembles a conventional adjustable wrench, having a handle portion 32, a first fixed jaw 34, and a second movable jaw 36 which can be caused to move in directions toward or away from the fixed jaw 34. The movable jaw 36 is coupled to a sliding rack mechanism 38 having teeth 40 which may be engaged by a worm gear 42 that can be actuated by a user, as known in the art, to cause the movable jaw 36 to move toward or away from the fixed jaw 34. In the embodiment shown, the adjustable wrench 30 includes a clamping member 44 slidably coupled to the first, fixed jaw 34. Accordingly, the fixed jaw 34 includes a first support surface 46 against which the first surface 48 of the clamping member 44 is in sliding contact. The second surface 50 of the clamping member 44 is disposed at an angle θ from the first support surface 46 and the first surface 48 of the clamping member 44, wherein the angle θ is defined by the equation set forth above.

The wrench 30 may further include a pair of guide rods 52 secured proximate the fixed jaw 34 and having longitudinal axes 54 aligned with the first surface 48. The guide rods 52 are secured to the wrench 30 between the body 56 of the wrench head and a protruding ledge 58 extending from the distal end of the fixed jaw 34. In the embodiment shown, respective ends of the guide rods 52 are received in apertures 60, 62 in the wrench body 56 and the ledge 58. Corresponding apertures 64 are formed through the clamping member 44 to receive the guide rods 52 therethrough, whereby the clamping member 44 is constrained by the guide rods 52 to move slidably along the first support surface 46. The wrench 30 may further include springs 66, or other resilient members, provided on the fixed jaw 34 and cooperating with the clamping member 44 to bias the clamping member 44 in a direction outwardly from the apex of the defined angle θ, which corresponds to a direction to lessen the clamping action on a clamped object.

In use, an object to be clamped is positioned between the fixed and movable jaws 34, 36 of the wrench 30, and the worm gear 42 is manipulated by a user to move the movable jaw 36 in a direction toward the fixed jaw 34 until the object is contacted by the clamping member 44 and the movable jaw 36. Thereafter, if the handle 32 is manipulated to pull the wrench 30 in the direction indicated by arrow 68, the clamping member 44 will slide along the first support surface 46, in a direction toward the protruding ledge 58, and the object will be clamped between the clamping member 44 and the movable jaw 36, in a manner similar to that described above with respect to FIG. 1. Moreover, the object will be clamped regardless of any backlash that may be present between worm gear 42 and rack 38.

If the handle 32 is pushed in a direction opposite arrow 68, the clamping member 44 will slip and permit the object to be un-clamped. By sequentially manipulating the wrench 30 in the direction of arrow 68, and then in the direction opposite arrow 68, the wrench 30 enables users to turn a bolt or other cylindrically-shaped object in one direction, without having to remove the wrench 30 from the object and without requiring further adjustment of the worm gear 42.

While this embodiment has been shown and described with the clamping member 44 provided on the fixed jaw 34, it will be recognized that the clamping member 44 may alternatively be provided on the moving jaw 36. Wrench 30 may further include a low friction material 69 disposed at the interface between the first support surface 46 on the fixed jaw 34 and the first surface 48 of the clamping member 44, as depicted in FIG. 3. Alternatively, the first and second surfaces 48, 50 of the clamping member 44, and the first support surface 46 may be coated or treated, as described above, to provide desired friction coefficients in accordance with the principles of the present invention.

Figure 4:
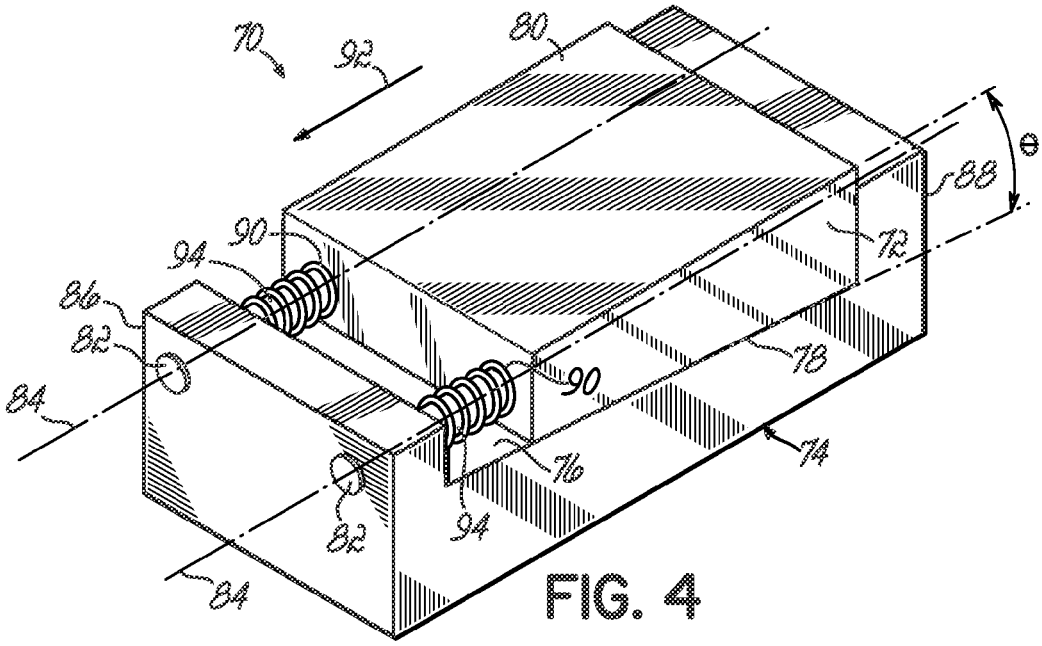
FIG. 4 is a perspective view of a second embodiment of a clamping mechanism in accordance with the principles of the present invention.

FIG. 4 depicts another exemplary clamping mechanism 70 in accordance with the principles of the present invention. The clamping mechanism 70 may be used alone, or in combination with a vise or other tool (not shown) to clamp an object against the clamping member 72. The clamping mechanism 70 comprises a main body 74 defining a first support surface 76 against which the clamping member 72 is slidably disposed with its first surface 78 in contact with the first support surface 76 in a manner similar to that described above. The clamping member 72 further includes a second surface 80 for engaging an object to be clamped. The second surface 80 of the clamping member 72 is disposed at an angle θ from the first surface 78 of the clamping member 72 and the first support surface 76, wherein the angle θ is defined by the equation discussed above.

A pair of guide rods 82 are spaced from the first support surface 76 and are aligned with their longitudinal axes 84 parallel to the first support surface 76. The respective ends of the guide rods 82 are secured to the base 74 at end walls 86, 88 extending upwardly from the first support surface 76. Corresponding apertures 90 through the clamping member 72 receive the guide rods 82 therethrough, such that the clamping member 72 is constrained by the guide rods 82 to move along the first support surface 76, in a manner similar to that described above. Accordingly, when an object to be clamped is engaged by the second surface 80 of the clamping member 72 and external forces are applied to the object to cause the object and the clamping member 72 to move in the direction of arrow 92, the clamping member 72 slides along the first support surface 76 and a normal force is applied to the object to maintain the clamped condition of the object.

The clamping mechanism 70 may further include springs 94 or other biasing members cooperating with the clamping member 72 to move the clamping member 72 in a direction opposite arrow 92, which corresponds with a direction for reducing the clamped condition of the mechanism 70. In the embodiment shown, a pair of coil springs 94 are disposed longitudinally along the guide rods 82, but it will be appreciated that various other biasing mechanisms may be utilized to urge the clamping member 72 in a direction toward the unclamped condition for quick and easy release of the clamped object when desired.

Figure 5:
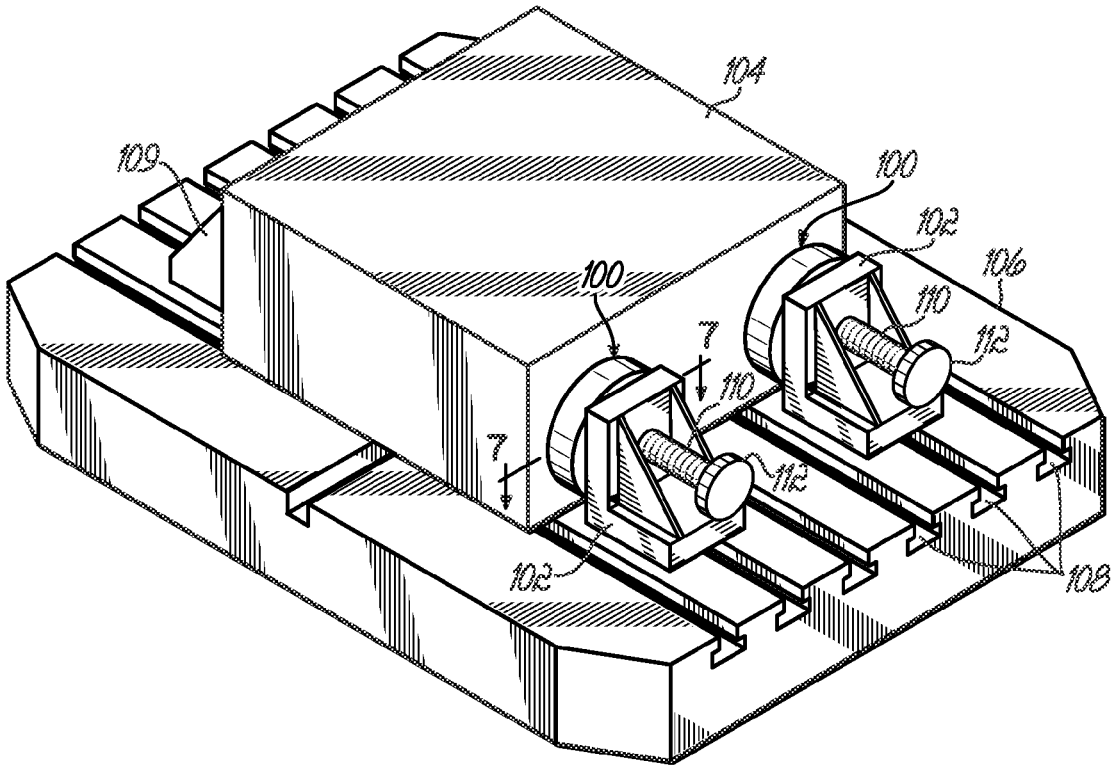
FIG. 5 is a perspective view of a clamping device utilizing a third embodiment of a clamping mechanism in accordance with the principles of the present invention
Figure 6:
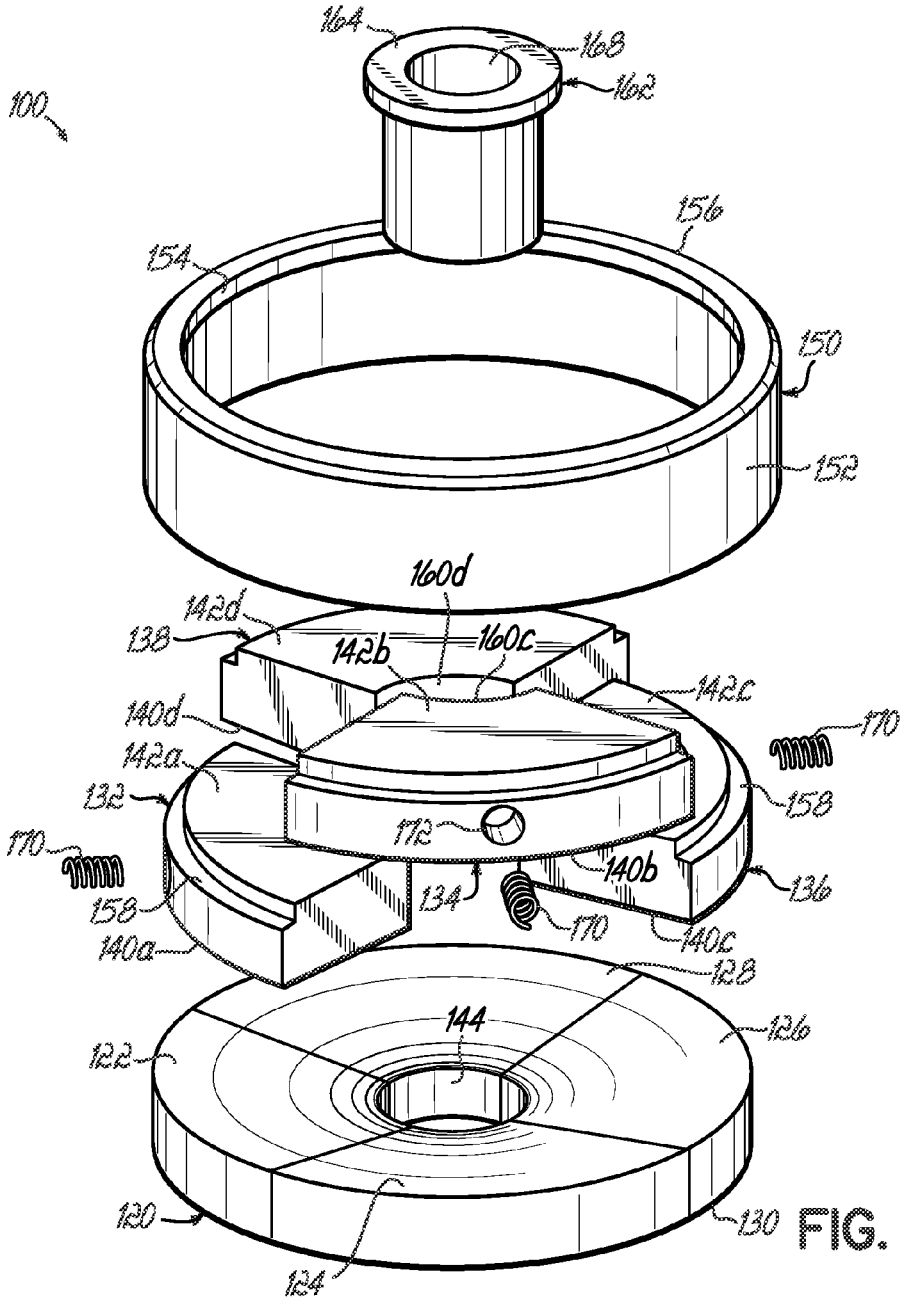
FIG. 6 is an exploded perspective view of the clamping mechanism of FIG. 5.
Figure 7:
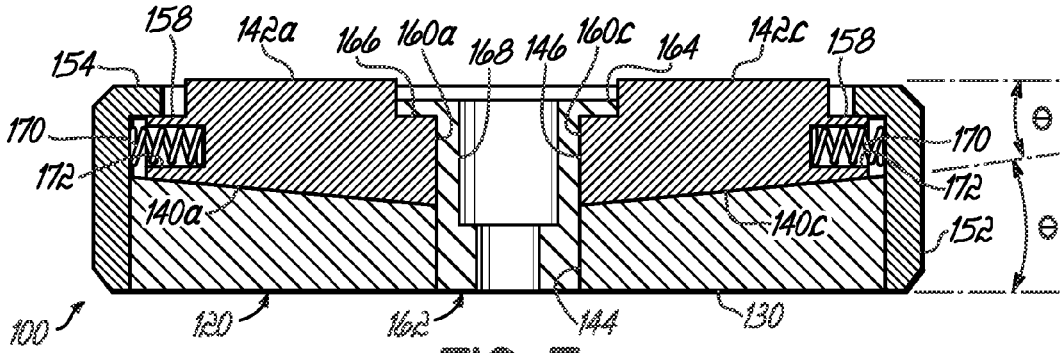
FIG. 7 is a cross-sectional view of the clamping mechanism of FIG. 5, taken along line 7-7.

FIGS. 5-7 depict another exemplary clamping mechanism 100 in accordance with the principles of the present invention. In this embodiment, the clamping mechanism 100 comprises a generally disk-shaped device configured to clamp an object against movement in directions radially outwardly from the center of the disk. FIG. 5 illustrates use of the disk-shaped clamping mechanism 100, for example, to clamp a workpiece or object 104 while machining operations are performed on the object 104. In the embodiment shown, a pair of clamping mechanisms 100 are supported by angle bracket members 102 on one side of the object 104 to clamp the object 104 on a machining table 106. The table 106 includes a plurality of T-shaped slots 108 for slidably adjustably positioning the clamping mechanisms 100 and corresponding stop members 109 (only one shown) on the table 106. The angle brackets 102 include threaded rods 110 which may be manipulated by adjustment knobs 112 to urge the clamping mechanisms 100 in directions toward the object 104 whereby the object 104 may be clamped between the clamping mechanisms 100 and corresponding stop members 109.

With reference to FIGS. 6 and 7, the clamping mechanism 100 of this embodiment includes a disk-shaped support member 120 with a first support surface defined by four generally planar surfaces 122, 124, 126, 128 that are inclined at equal angles θ (see FIG. 7) relative to an opposite face 130 of the disk, in directions extending radially outwardly from a center of the disk. The clamping member comprises four arcuate segments 132, 134, 136, 138 corresponding to the four planar surfaces 122, 124, 126, 128 of the support member 120. Each segment 132, 134, 136, 138 includes a first surface 140*a*, 140*b*, 140*c*, 140*d* for slidingly engaging the planar surfaces 122, 124, 126, 128 of the support member 120, and a second surface 142*a*, 142*b*, 142*c*, 142*d* for engaging an object to be clamped. In the assembled condition, the four segments 132, 134, 136, 138 are arranged around a central aperture 144 through the disk-shaped support member 120 to define a generally circular clamping surface having a central aperture 146 in registration with the central aperture 144 through the support member 120.

The clamping mechanism 100 further includes a housing 150 having a circumferentially extending sidewall 152 and a radially inwardly extending lip 154 formed around an upper end 156 of the sidewall 152. The disk-shaped support member 120 is press-fit within the housing 150, and the radially extending lip 154 overlaps outer circumferential edges 158 defined by the clamping member segments 132, 134, 136, 138 to retain the clamping member segments 132, 134, 136, 138 within the housing 150. The respective inner circumferential edges 160*a*, 160*b*, 160*c*, 160*d* of the clamping member segments 132, 134, 136, 138 are retained by a tubular-shaped bushing 162 that is press-fit through the central aperture 144 in the support member 120. The bushing 162 has a radially outwardly extending flange 164 that overlaps an annular ledge 166 formed around the central aperture 146 defined by the clamping member segments 132, 134, 136, 138. A counter-bored aperture 168 through bushing 162 may be provided to facilitate securing clamping mechanism 100 to supporting structure such as angle brackets 102 or other structure.

The radial widths of the clamping member segments 132, 134, 136, 138 are less than the outer radius of the support member 120 and the corresponding inner radius of the housing sidewall 152, so that the clamping member segments 132, 134, 136, 138 are able to move radially outwardly by sliding along the planar surfaces 122, 124, 126, 128 of the support member 120. When the second surfaces 142*a*, 142*b*, 142*c*, 142*d* of the clamping member segments 132, 134, 136, 138 are engaged with an object to be clamped and the object is thereafter acted upon by forces to move the object in directions radially outwardly from the center of the clamping mechanism 100, initial movement of the object causes at least one of the clamping member segments 132, 134, 136, 138 to slide along the first support surface in a direction radially outwardly from the center of the clamping mechanism 100 to thereby apply additional clamping force to the object and resist such movement, in a manner similar to that described above.

The clamping mechanism 100 may further include springs 170 or other biasing members cooperating with the clamping member segments 132, 134, 136, 138 to urge the clamping member segments 132, 134, 136, 138 in directions radially inwardly and corresponding to directions for reducing the clamping action on the object. In the embodiment shown, the biasing members comprise coil springs 170 disposed between the outer circumferential edges of the clamping segments 132, 134, 136, 138 and the inner surface of the housing sidewall 150. Radially extending apertures 172 are provided in the outer edges of the clamping member segments 132, 134, 136, 138 to receive portions of the springs 170 therein.

While clamping mechanism 100 has been shown and described herein as having four clamping member segments 132, 134, 136, 138, it will be appreciated that the clamping mechanism 100 may alternatively have two or three clamping member segments, or more than four clamping member segments, as may be desired for particular applications.

Figure 8:
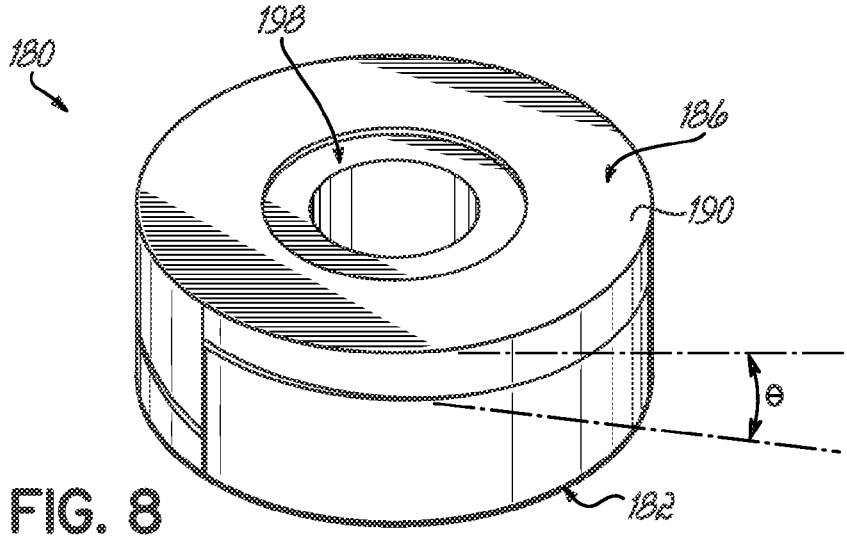
FIG. 8 is a perspective view of a fourth exemplary clamping mechanism in accordance with the principles of the present invention.
Figure 9:
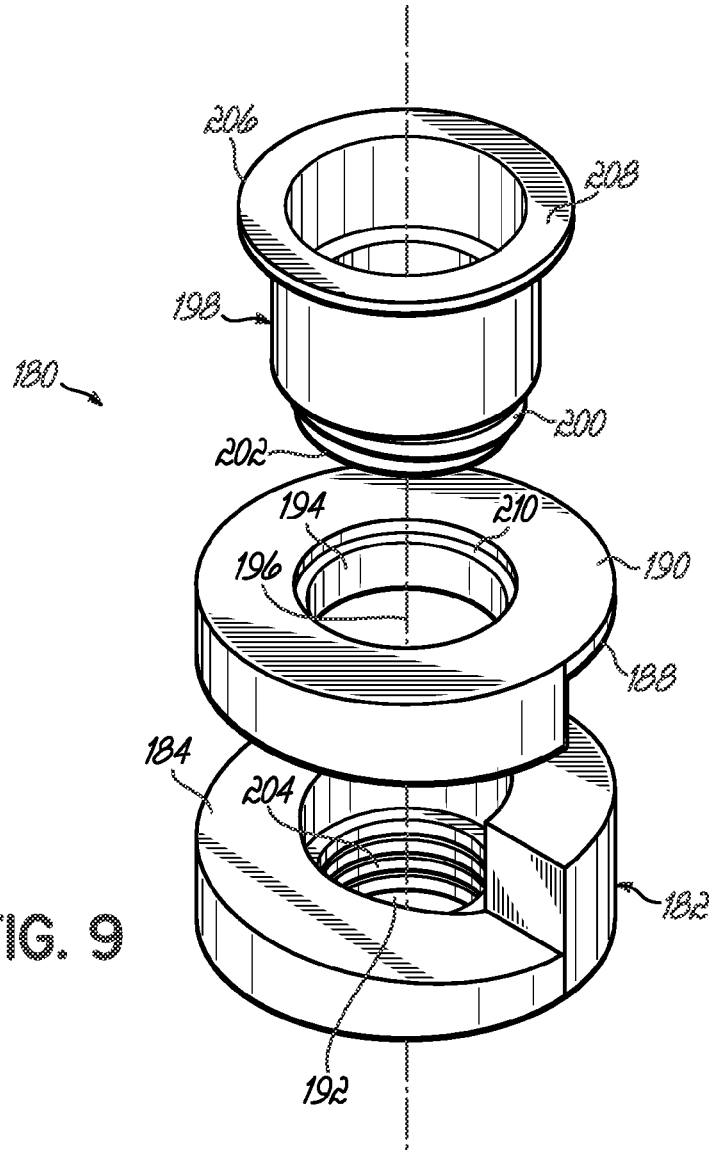
FIG. 9 is an exploded perspective view of the clamping mechanism of FIG. 8.

FIGS. 8-9 depict yet another exemplary clamping mechanism 180 in accordance with the principles of the present invention, wherein the clamping mechanism 180 is configured to clamp against rotational movement of an object, or to resist torque forces applied to an object. The clamping mechanism 180 includes a first support 182 defining an inclined, spirally-extending first support surface 184. A clamping member 186 has an inclined, spirally-extending first surface 188 complementary to the first support surface 184, for sliding contact therewith. Accordingly, the first support surface 184 and the first surface 188 of the clamping member 186 define a helix angle corresponding to the angle θ set forth in the equation discussed above. A second surface 190 of the clamping member 186 forms an angle θ with the first surface 188 and is adapted to engage an object to be clamped against rotation.

The first support 182 and the clamping member 186 have central bores 192, 194 aligned in registry to one another and extending in directions parallel to the axis 196 of the helix defined by the respective first surfaces 184, 188 thereof. The first support 182 and the clamping member 186 are coupled together by a tubular connecting member 198 fixed to the first support 182 and extending through the central bore 192. In the embodiment shown, the connecting member 198 has external threads 200 formed on a first end 202 to enable threadably coupling the connecting member 198 to the first support 182 at corresponding internal threads 204 formed in the central bore 192. An oppositely disposed second end 206 of the connecting member 198 includes a radially outwardly extending flange 208 sized to be received within the central bore 194 of the clamping member 186. The flange 208 engages a circumferential ledge 210 formed within the central bore 194 of the clamping member 186 to retain the claiming member 186 on the first support 182 while permitting rotation and limited axial movement of the clamping member 186 relative to the first support 182. The amount of axial movement and rotation of the clamping member 186 relative to the first support 182 can be established by appropriate selection of a spacing between the flange 208 on the connecting member 198 and the ledge 210 in the central bore 194 of the clamping member 186.

When the clamping mechanism 180 is assembled with the clamping member 186 coupled to the first support 182, rotation of the clamping member 186 relative to the first support 182 causes the clamping member 186 to move up the inclined first support surface 184 such that the clamping member 186 is advanced outwardly from the first support in a direction parallel to the axis 196. The clamping mechanism 180 may therefore be used to clamp objects against rotation in a manner similar to the clamping mechanisms described above. When an object is engaged by the second surface 190 of the clamping member 186, rotational movement of the object will cause the clamping member 186 to initially move along the helical first support surface 184 and also in a direction axially toward the object. The axial advancement of the clamping member 186 toward the object applies a force to the object in a direction normal to the surface of the object. When the helix angle θ satisfies the equation set forth above, the object will be clamped against rotational movement between the clamping member 186 and a second support surface (not shown). The first support surface 184 and the first and second surfaces 188, 190 of the clamping member 186 may be coated or otherwise treated to modify the friction characteristics of the surfaces, or materials having desired friction characteristics may be positioned adjacent the surfaces 184, 188, 190, as discussed above.

While the clamping mechanism 180 has been described for use in clamping an object against rotation, it will be appreciated that the mechanism 180 may alternatively be used as a clutch or brake, to transmit or resist torques. Specifically, rotational movement of an object contacting the second surface 190 of the clamping member 186 actuates the clamping member 186, as described above, to resist movement of the object and, therefore, the torque associated with the rotational movement of the object. Similarly, when the clamping member 186 is in contact with the object and a torque is applied to the mechanism 180, the first support 182 will initially rotate relative to the clamping member 186 as the clamping member 186 is advanced along the inclined first support surface 184. After this initial movement, the frictional forces between the object and the clamping member 186 will increase, and if the helix angle θ satisfies the equation set forth above, torque will be transmitted through the clamping mechanism 180 to the object.

Figure 10:
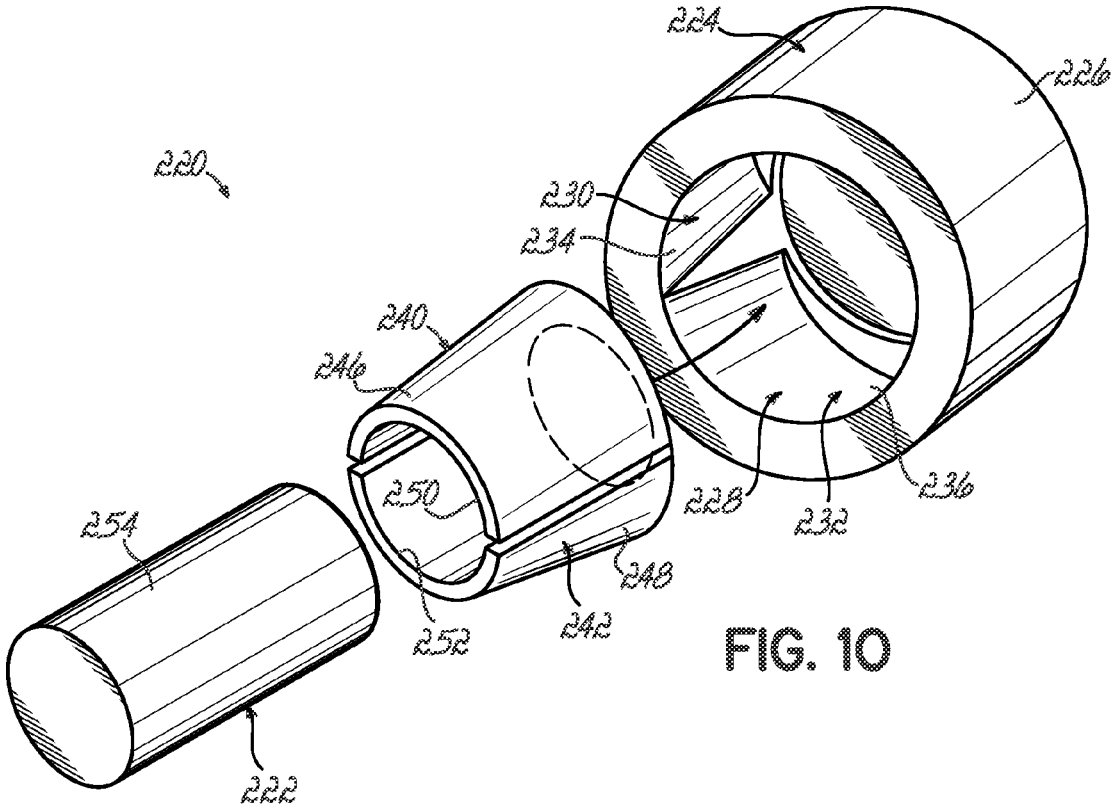
FIG. 10 is an exploded perspective view of a fifth exemplary clamping mechanism in accordance with the principles of the present invention.
Figure 11:
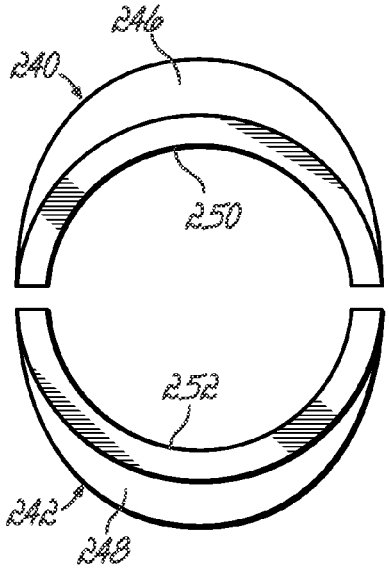
FIG. 11 is a top plan view of the clamping members of the mechanism depicted in FIG. 10.
Figure 12:
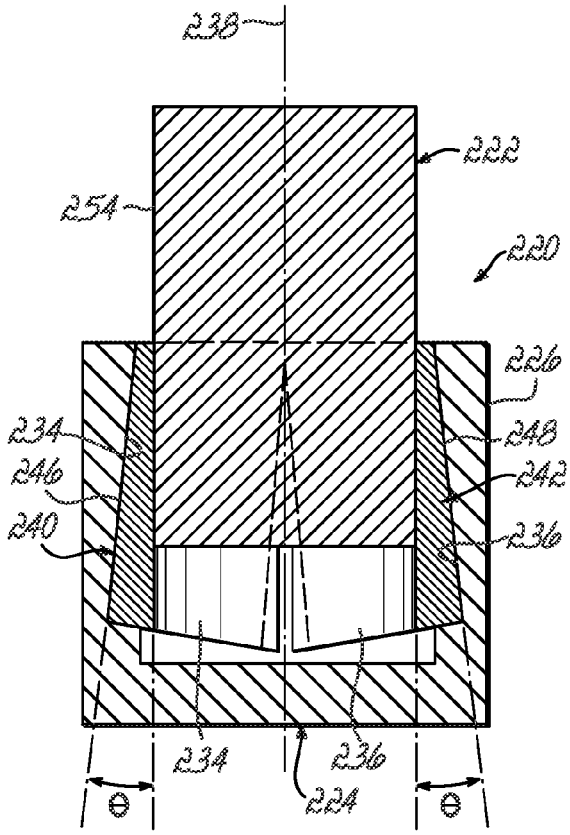
FIG. 12 is a cross-sectional view of the clamping mechanism of FIG. 10.

FIGS. 10-12 depict another exemplary clamping mechanism 220 in accordance with the principles of the present invention, for clamping rod-shaped objects 222 against axial movement. In this embodiment, the support comprises a cylindrically-shaped housing 224 having a circumferential sidewall 226 and an opening 228 at one end for access into the interior of the housing 224. A pair of pockets 230, 232 are formed into the inner surface of the sidewall 226, on diametrically opposite sides of the housing 224, to define first support surfaces 234, 236. The first support surfaces 234, 236 are inclined at an angle θ with respect to a longitudinal axis 238 of the housing 224, such that the first support surfaces 234, 236 are sloped radially inwardly toward the opening 228 of the housing 224.

The clamping mechanism 220 further includes first and second elongate, arcuately-shaped clamping members 240, 242 disposed within the housing 224. The clamping members 240, 242 are spaced apart in confronting relation and each of the clamping members 240, 242 are nested within one of the pockets 230, 232 such that radially outwardly facing first surfaces 246, 248 of the respective clamping members 240, 242 contact the respective first support surfaces 234, 236. The first surfaces 246, 248 of the clamping members are inclined at angle θ relative to axis 238 to mate with the respective first support surfaces 234, 236, whereby the clamping members 240, 242 may slidingly move along the first support surfaces 234, 236 in directions toward the opening 228 of the housing 224. The clamping members 240, 242 further include radially inwardly facing second surfaces 250, 252 for engaging the outer circumference 254 of a rod-shaped object 222 that may be inserted into the opening 228 of the housing 224. When the angle θ satisfies the equation set forth above, the clamping members 240, 242 cooperate with the housing 224 to easily admit the rod-shaped object 222 between the respective clamping members 240, 242, but will clamp against the object 222 to prevent movement in a direction to withdraw the object 222 from the housing 224.

While the clamping mechanism 220 has been shown and described herein as having two clamping members 240, 242 for clamping against rod-shaped objects 222, it will be recognized that a clamping mechanism 220 in accordance with the principles of the present invention may alternatively have only a single clamping member, or more than two clamping members, disposed within the housing 224 and configured to engage the circumference 254 of the rod-shaped object 222.

Figure 13:
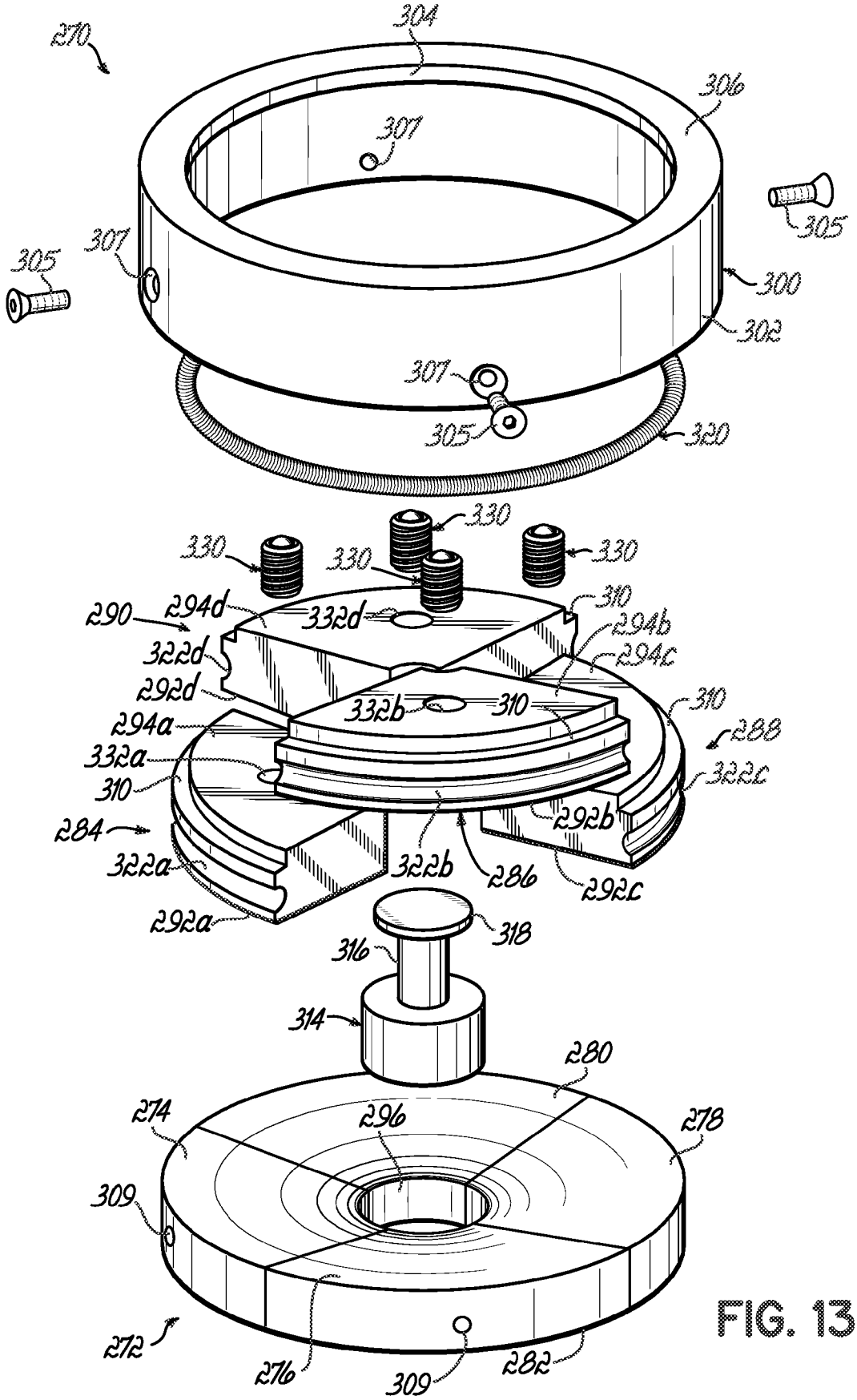
FIG. 13 is an exploded perspective view of a sixth exemplary clamping mechanism.
Figure 14:
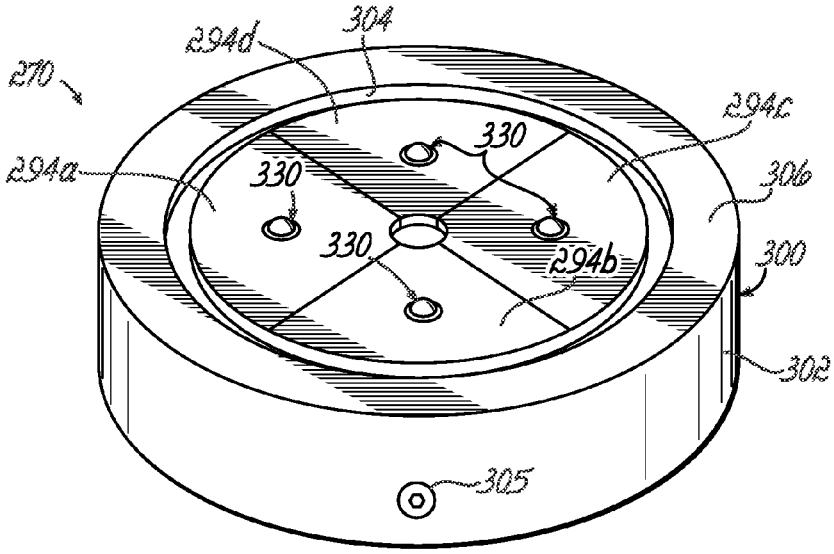
FIG. 14 is a perspective view of the assembled clamping mechanism of FIG. 13.
Figure 15:
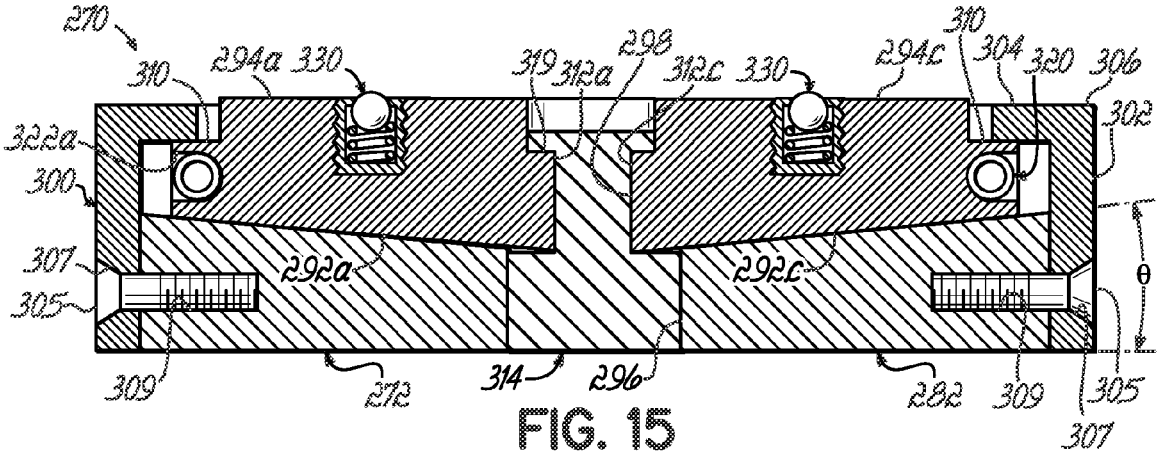
FIG. 15 is a cross-sectional view of the clamping mechanism of FIG. 14.

FIGS. 13-15 depict another exemplary embodiment of a clamping mechanism 270 in the form of a disk-shaped device similar to the disk-shaped clamping mechanism 100 of FIGS. 5-7 and configured to clamp objects against movement in directions radially outwardly from the center of the disk. The clamping mechanism 270 includes a disk-shaped support member 272 with a first support surface defined by four generally planar surfaces 274, 276, 278, 280 that are inclined at angles θ relative to an opposite face 282, in directions extending radially outwardly from a center of the disk (see FIG. 15).

The clamping member comprises four arcuate segments 284, 286, 288, 290 corresponding to the four planar surfaces 274, 276, 278, 280 of the support member 272. Each segment 284, 286, 288, 290 includes a first surface 292*a*, 292*b*, 292*c*, 292*d* for slidingly engaging the planar surfaces 274, 276, 278, 280 of the support member 272, and a second surface 294*a*, 294*b*, 294*c*, 294*d* for engaging an object to be clamped. In the assembled condition, the four segments 284, 286, 288, 290 are arranged around a central aperture 296 through the disk-shaped support member 272 to define a generally circular clamping surface having a central aperture 298 in registration with the central aperture 296 through the support member 272.

The clamping mechanism 270 further includes a housing 300 having a circumferentially extending sidewall 302 and a radially inwardly extending lip 304 formed around an upper end 306 of the sidewall 302. The disk-shaped support member 272 is secured within the housing 300 by threaded fasteners 305 inserted through counter-sunk apertures 307 disposed circumferentially around the sidewall 302 of housing 300 and into corresponding radially-extending tapped holes 309 in the support member 272. The radially extending lip 304 overlaps outer circumferential ledges 310 formed on the clamping member segments 284, 286, 288, 290 to retain the clamping member segments 284, 286, 288, 290 within the housing 300. Respective inner circumferential edges 312*a*, 312*b*, 312*c*, 312*d* of the clamping member segments 284, 286, 288, 290 are retained by a bushing 314 that is press-fit through the central aperture 296 in the support member 272. The bushing 314 has a reduced end portion 316 and a radially outwardly extending flange 318 that overlaps an annular ledge 319 formed around the central aperture 298 defined by the clamping member segments 284, 286, 288, 290.

The radial widths of the clamping member segments 284, 286, 288, 290 are less than the distance between the outer radius of the support member 272 and the corresponding inner radius of the housing sidewall 302, so that the clamping member segments 284, 286, 288, 290 are able to move radially outwardly by sliding along the planar surfaces 274, 276, 278, 280 of the support member 272. When the second surfaces 294*a*, 294*b*, 294*c*, 294*d* of the clamping member segments 284, 286, 288, 290 are engaged with an object to be clamped and the object is thereafter acted upon by forces to move the object in directions radially outwardly from the center of the clamping mechanism 270, initial movement of the object causes at least one of the clamping member segments 284, 286, 288, 290 to slide along the support member 272 in a direction radially outwardly from the center of the clamping mechanism 270 to thereby apply additional clamping force to the object and resist such movement, in a manner similar to that described above.

The clamping mechanism 270 further includes a biasing member 320 in the form of a hoop-shaped coil spring disposed around the circumference of the assembled clamping member segments 284, 286, 288, 290 such that the biasing member 320 urges the clamping member segments 284, 286, 288, 290 in directions radially inwardly and corresponding to directions for reducing the clamping action on an object. The biasing member 320 is received in respective grooves 322*a*, 322*b*, 322*c*, 322*d* on the respective segments 284, 286, 288, 290.

The clamping mechanism 270 further includes ball plungers 330 provided on each clamping member segment 284, 286, 288, 290. The ball plungers 330 are installed into holes 332*a*, 332*b*, 332*c*, 332*d* in the second surfaces 294*a*, 294*b*, 294*c*, 294*d* of the respective segments 284, 286, 288, 290, with the balls protruding above the second surfaces 294*a*, 294*b*, 294*c*, 294*d*. The balls are biased in directions outwardly of the second surfaces 294*a*, 294*b*, 294*c*, 294*d* by respective springs to provide initial activation of the clamping member segments 284, 286, 288, 290 as the clamping mechanism 270 is brought into contact with an object to be clamped. While the ball plungers 330 are depicted herein as having threaded housings for securing the ball plungers to 330 the respective segments 284, 286, 288, 290, it will be appreciated that ball plungers configured to be press-fit into holes may alternatively be used.

Figure 16:
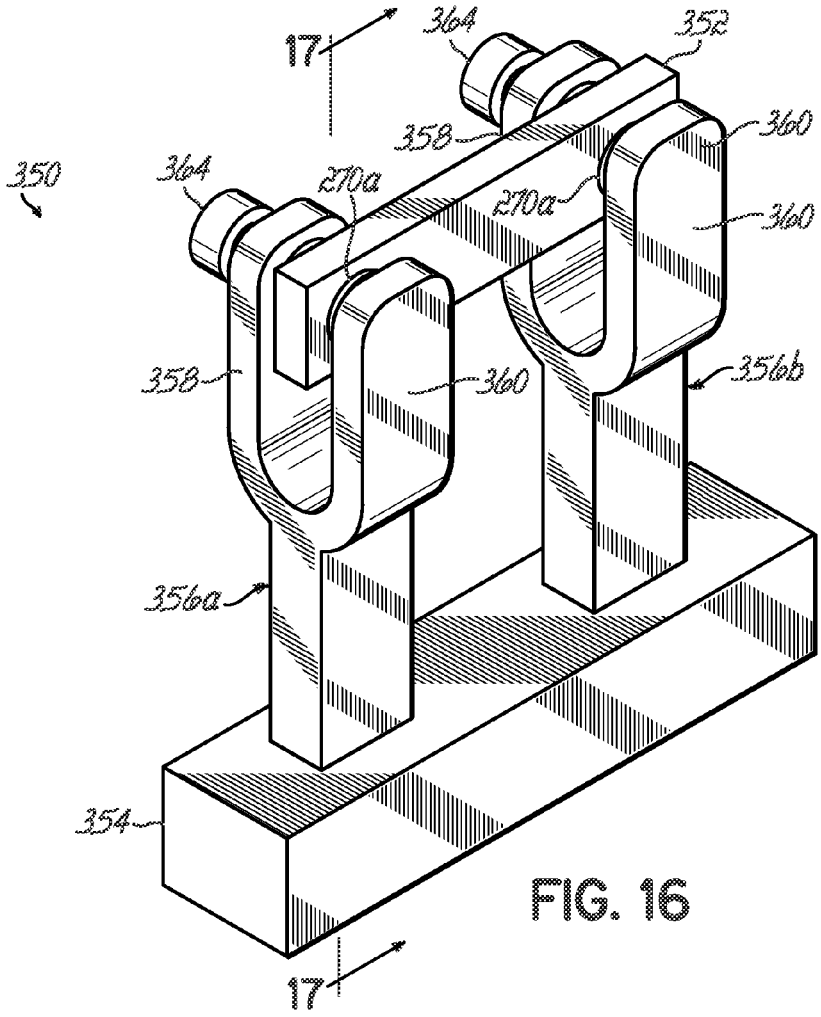
FIG. 16 is a perspective view of a bumper assembly utilizing a clamping mechanism similar to that shown in FIGS. 13-15.
Figure 17:
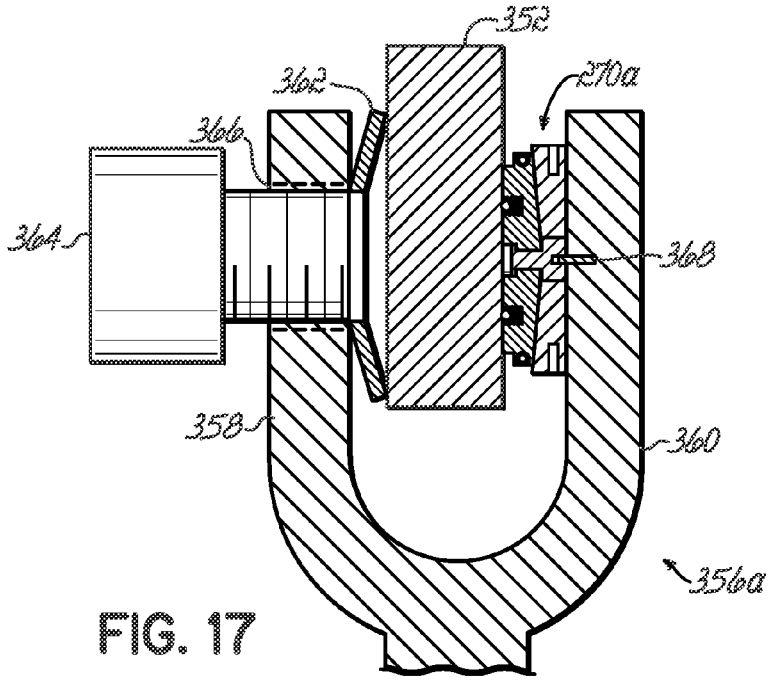
FIG. 17 is a partial cross-sectional view of the bumper assembly of FIG. 16, taken along line 17-17.

FIG. 16 depicts an exemplary embodiment of an application wherein a modified version of the clamping mechanism 270 described above is used in a bumper assembly 350 for supporting a metallic beam 352. In this embodiment, the modified clamping mechanism 270*a* includes all features described above with respect to FIGS. 13-15, except that housing 300 is omitted. The bumper assembly comprises a base 354 having first and second upstanding support members 356*a*, 356*b*. Each support member 356*a*, 356*b* includes first and second parallel arms 358, 360 spaced apart a distance to support the metallic beam 352 therebetween. As depicted more clearly in FIG. 17, the metallic bumper 352 is supported between the first and second arms 358, 360 by the modified clamping mechanism 270*a* and a disk spring, or Bellville washer 362. The disk spring 362 is secured to the first arm 358 by a threaded fastener 364 inserted through tapped hole 366 in the first arm 358. Accordingly, the disk spring 362 may be urged in a direction toward the metallic beam 352 by threadedably advancing the fastener 364 through the tapped hole 366 to increase a preload force on the metallic beam 352. The modified clamping mechanism 270*a* is supported on the second arm 360 by a pin 368 disposed therebetween.

If a force acts upon the metallic beam 352 in any direction such that the beam 352 is caused to move, a clamping member segment 284, 286, 288, 290 of the modified clamping mechanism 270*a* acts against movement of the beam 352 in a manner similar to that described above. The clamping mechanism 270*a* will therefore apply forces to the metallic beam 352 that will tend to flatten the disk spring 362. Movement of the beam 352 will continue until the disk spring 362 is completely flattened, whereafter the beam 352 will be locked against further movement. A desired permissible amount of movement of the beam 352 may be selected by preloading the disk spring 362 with the fastener 364, as described above. The device 350 may therefore be used as a crash cushion or shock absorber, such as a safety bumper for an automobile for example.

Figure 18:
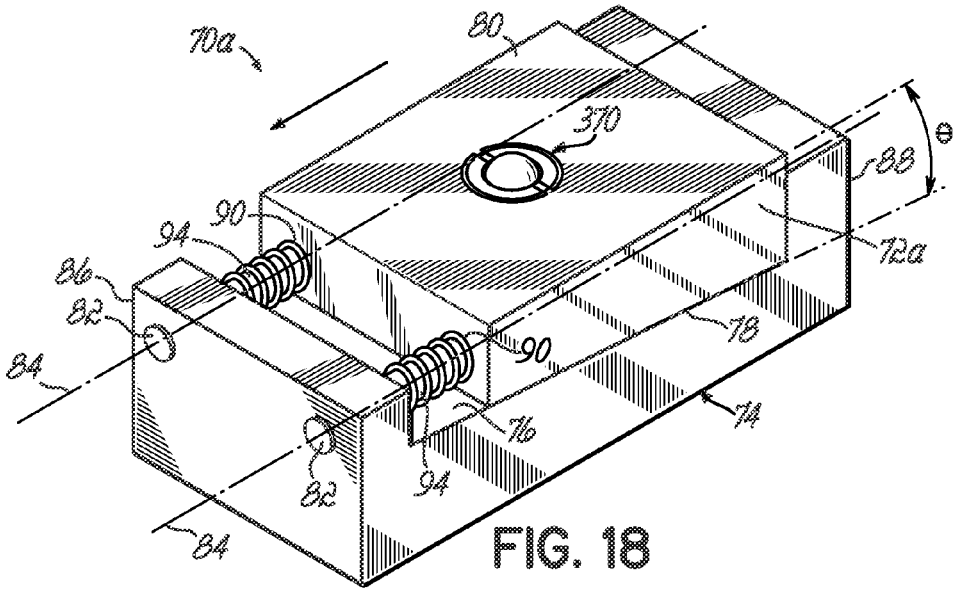
FIG. 18 is a perspective view of a seventh exemplary clamping mechanism.

FIG. 18 depicts another embodiment of a clamping mechanism 70*a*, similar to the clamping mechanism 70 described above with respect to FIG. 4 and similar features are similarly numbered. The clamping mechanism 70*a* includes a clamping member 72*a* with a ball plunger 370 provided adjacent the second surface 80. The ball plunger 370 provides initial activation of the clamping mechanism 70*a* upon initial contact with an object to be clamped. The mechanism 70*a* otherwise operates as described above with respect to FIG. 4.

While the present invention has been illustrated by the description of exemplary embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A self-clamping apparatus in the form of an adjustable wrench for clamping against a surface of an object, comprising:

a first support surface;

a clamping member having a first surface in confronting engagement with said first support surface and slidably movable therealong, said clamping member having a second surface for engaging the surface of the object, said first surface disposed at an angle θ to said second surface, said angle θ defined by:

$$\frac{k+\tan(\theta)}{1-k\tan(\theta)} \leq \mu$$

wherein:

μ=the coefficient of friction between said clamping member and an object to be clamped k=the coefficient of friction between said clamping member and said first support surface;

wherein said first and second surfaces of said clamping member are substantially smooth;

a second support surface opposite said first support surface, said clamping member disposed between said first and second support surfaces;

wherein at least one of said first and second support surfaces is movable relative to the other of said first and second support surfaces to increase and decrease a distance therebetween;

a handle;

a first jaw integral with said handle; and a second jaw selectively adjustably positionable relative to said first jaw;

said first support surface associated with one of said first and second jaws;

said second support surface associated with the other of said first and second jaws.

2. The self-clamping apparatus of claim 1, further comprising:

at least one guide rod aligned with said first support surface, said guide rod constraining movement of said clamping member therealong.

3. A self-clamping apparatus for clamping against a surface of an object, comprising:

a first support surface;

a clamping member having a first surface in confronting engagement with said first support surface and slidably movable therealong, said clamping member having a second surface for engaging the surface of the object, said first surface disposed at an angle θ to said second surface, said angle θ defined by:

$$\frac{k+\tan(\theta)}{1-k\tan(\theta)} \leq \mu$$

wherein:

μ=the coefficient of friction between said clamping member and an object to be clamped k=the coefficient of friction between said clamping member and said first support surface;

wherein said support surface comprises a disk defining at least two planar surfaces inclined at said angle θ in directions radially outwardly from a center of said disk; and wherein said clamping member comprises at least first and second portions, each portion associated with one of said planar surfaces for sliding movement therealong;

whereby the self-clamping apparatus resists movement of the object in directions radially outward from said center of said disk.

4. The self-clamping apparatus of claim 3, wherein:

said support surface comprises a disk defining four planar surfaces, each planar surface inclined at said angle θ in directions radially outwardly from a center of said disk; and said clamping member comprises four portions, each portion associated with one of said planar surfaces for sliding movement therealong.-

5. The self-clamping apparatus of claim 3, further comprising:

a biasing member associated with each said clamping member portion.

6. The self-clamping apparatus of claim 3, further comprising:

a housing surrounding at least portions of said support surface and said clamping member.

7. The self-clamping apparatus of claim 3, further comprising:

a retaining member having a stop that limits movement of said clamping member relative to said support surface.

8. A self-clamping apparatus for clamping against a surface of an object, comprising:

a first support surface; and a clamping member having a first surface in confronting engagement with said first support surface and slidably movable therealong, said clamping member having a second surface for engaging the surface of the object, said first surface disposed at an angle θ to said second surface, said angle θ defined by:

$$\frac{k + \tan(\theta)}{1 - k\tan(\theta)} \leq \mu$$

wherein:

μ=the coefficient of friction between said clamping member and an object to be clamped k=the coefficient of friction between said clamping member and said first support surface;

wherein said clamping member is slidably rotatably movable relative to said first support surface and said angle θ defines a helix angle between said first surface of said clamping member and said first support surface.

9. A self-clamping apparatus for clamping against a surface of an object, comprising:

a first support surface; and a clamping member having a first surface in confronting engagement with said first support surface and slidably movable therealong, said clamping member having a second surface for engaging the surface of the object, said first surface disposed at an angle θ to said second surface, said angle θ defined by:

$$\frac{k + \tan(\theta)}{1 - k\tan(\theta)} \leq \mu$$

wherein:

μ=the coefficient of friction between said clamping member and an object to be clamped k=the coefficient of friction between said clamping member and said first support surface;

wherein said second surface of said clamping member is arcuate in shape to engage a circumferential surface of a rod-shaped object.

10. The self-clamping apparatus of claim 9, further comprising:

a housing having an interior wall;

said support surface comprising an inclined face on said interior wall.

11. The self-clamping apparatus of claim 10, wherein said clamping member comprises first and second arcuate-shaped portions disposed within said housing.

* * * * *